US005916856A

United States Patent [19]

Massaro et al.

[11] Patent Number: 5,916,856

[45] **Date of Patent: *Jun. 29, 1999**

[54] POURABLE CAST MELT BAR COMPOSITIONS COMPRISING LOW LEVELS OF WATER AND MINIMUM RATIOS OF POLYOL TO WATER

[75] Inventors: Michael Massaro, Congers, N.Y.; Michael Fair, Hackensack, N.J.; Sanghee Park, Palisades Park, N.J.; Laurie Coyle, Garfield, N.J.; Gail Beth Rattinger, Teaneck, N.J.; Kevin Finucane, Saddle Brook, N.J.

[73] Assignee: Lever Brothers Company, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/733,036

[22] Filed: Oct. 16, 1996

[51] Int. Cl.[6] ..... C11O 3/32

[52] U.S. Cl. ..... 510/141; 510/151; 510/153; 510/155; 510/156; 510/474

[58] Field of Search ..... 510/151, 153, 510/155, 156, 474, 141

[56] References Cited

U.S. PATENT DOCUMENTS

| | | | |
|---|---|---|---|
| 5,227,086 | 7/1993 | Kacher et al. | 252/112 |
| 5,262,079 | 11/1993 | Kacher et al. | 252/112 |
| 5,312,559 | 5/1994 | Kacher et al. | 252/125 |
| 5,520,840 | 5/1996 | Massaro et al. | 252/174.17 |
| 5,540,854 | 7/1996 | Fair et al. | 510/152 |
| 5,820,840 | 5/1996 | Massaro et al. | 252/176.21 |

FOREIGN PATENT DOCUMENTS

95/26710 10/1995 WIPO .

*Primary Examiner*—Necholus Ogden
*Attorney, Agent, or Firm*—Ronald A. Koatz

[57] ABSTRACT

The present invention relates to cast melt bar composition comprising surfactant, fatty acid, generally lower MW polyalkylene glycol and small amounts of water wherein the ratio of total polyol to water is at least 3:1. By using less water and greater variants of polyol, the bars allow larger amounts of generally insoluble materials to be used and also allow retention of bar integrity using limited amounts of soap (important for mildness).

10 Claims, No Drawings

POURABLE CAST MELT BAR COMPOSITIONS COMPRISING LOW LEVELS OF WATER AND MINIMUM RATIOS OF POLYOL TO WATER

FIELD OF THE INVENTION

The present invention relates to cast melt bar compositions which, because they are cast melt, are able to be processed and simultaneously, if desired, can deliver greater amounts of benefit agent (e.g., in extrusion bars, delivery of benefit agent is often difficult when benefit agent is used in small amounts and, when amounts large enough to enhance deposition are used, the bars are often soft and extremely difficult to process). Further, because of low water levels and minimum ratios of polyol to water, the bars can be cast melt and deliver water soluble components normally very difficult to deliver.

BACKGROUND

Personal washing bars are constantly moving toward milder formulations that ultimately will provide some enhanced skin care, often in the form of a deposited emollient oil. In classic bar extrusion technology (i.e., where ingredients are combined and mixed at higher temperatures, chilled to form chips, and chips are plodded and extruded) it is extremely difficult to provide high levels of low melting point emollients and mild, water soluble surfactants (e.g., liquid components). Using so-called cast melt technology (e.g., liquid components are allowed to cool in a mold to form the final bar), however, bars can be prepared which more readily tolerate high levels of such liquid components. More specifically, and while not wishing to be bound by theory, this is believed to be because it is the network structure of the crystallized solid component of the bars (e.g., fatty acid soap) which is capable of entrapping high levels of liquid. While the extrusion process destroys the network structure and irreversibly causes liquid phase separation, cast melting allows the network structure to form unimpeded, where it can function to entrap liquid component.

In prior art cast melt compositions, however, minimum levels of water have been required to dissolve soap components necessary to form crystalline network structure while retaining low viscosity, isotropic melt. When not enough water was used (i.e., 10% minimum required), the formulations of the art were unprocessable (i.e., viscosity too high to pour). Further, as noted minimum water levels were required to dissolve soap and form crystalline network structure.

U.S. Pat. No. 5,227,086 to Kacher et al. and U.S. Pat. No. 5,262,079 to Kacher et al., for example, both provide framed (i.e., cast melt) skin cleansing bars comprising 5 to 50% fatty acid (20% to 65% neutralized in the case of U.S. Pat. No. 5,262,079 and essentially free fatty acid in the case of U.S. Pat. No. 5,227,086); about 15% to 65% of an anionic or nonionic bar firmness aid and 15% to 55% water.

WO 95/26710 (assigned to Procter and Gamble) claims lathering, skin cleansing bars comprising (a) 5 to 40 parts of a lipid skin moisturizer; (b) 10 to 50 parts of fatty acid soap; 1 to 50 parts lathering synthetic surfactant; and (d) 10 to 50 parts water.

As clearly stated at page 20 of the WO 95/26710 reference, levels of water below 10% would have seriously compromised these bars because the compositions would be unprocessable (i.e., viscosity too high to pour). By contrast, even at levels below 10% water, the bars of the invention form from a pourable, isotropic mixture.

In U.S. Pat. No. 5,520,840 to Massaro et al., applicants claim a bar (principally designed to be extruded, not cast melt) with compositions similar in some respect to the compositions of the invention.

The compositions of that reference comprise 10–60% synthetic surfactant; a water soluble structurant (which is preferably a moderately high molecular weight polyalkylene oxide or mixture of polyalkylene oxides); a water insoluble structurant (e.g., fatty acid) and low levels of water.

Because, however, these compositions are generally designed as extruded bar compositions, there are several major differences between them and the bars of the invention.

First, the polyol component (b) of the bars of the invention must have a much higher "liquid" (e.g., lower molecular weight) component than the bars of Massaro in order to ensure the melt is pourable when casting for bar production. Thus, the bars of the invention require an alkylene polyol component (e.g., $C_2$ to $C_4$ alkylene glycol and/or glycerin) and further require that either the ratio of alkylene polyol or alkylene polyol plus benefit agent to polyalkylene glycol is about 0.8:1 and higher.

Second, the bars of Massaro have preferably no more than 10% soap while those of the invention have greater than 10% soap, preferably 10.5% to 20% by weight soap. While not wishing to be bound by theory, minimum levels of soap are believed required in cast melt technology to form a network structure capable of entrapping liquid component (e.g. water and low molecular weight polyol). By contrast, extruded bars do not necessarily require such minimal amounts of soap.

Third, the bars of Massaro (e.g., extrusion bars) teach little or no benefit agent (e.g., where silicone is used, it is used only as processing aid and, even these, only in amounts made below 0.5%. By contrast, bars of the invention comprise 0 to 30% by wt., preferably 1% to 25%, more preferably 1.5 to 15% by wt. benefit agent.

Finally, with regard to the Kacher et al. references, not only does Kacher et al. fail to teach criticality as to the types of polyol, but, even taken to the extreme (i.e., 10–50% water and 0.5 to 35% polyol taught in WO 95/26710), the highest ratio of polyol to water that could possibly be obtained is 35% to 10% or 3.5 to 1. It is clear, however, that Kacher contemplated generally much higher levels of water (e.g., 15 to 40% levels taught in U.S. references) and lower levels of polyol. As such, Kacher fails to teach or suggest the 3:1 levels, preferably at least 3.5 to 1, more preferably at least 4:1 polyol to water ratios of the subject invention. Such ratios are required by the subject invention to obtain a pourable region which can be successfully cast melt.

Stated differently, the intent of Kacher was clearly to provide high water to polyol ratio (see examples) since this was necessary for the processability of the bars. By contrast, the subject invention teaches that, even at high polyol to water ratio, successful processing is obtained.

BRIEF SUMMARY OF THE INVENTION

Unexpectedly, applicants have found a region wherein, by extremely careful selection of variables, it is possible to cast melt a bar while maintaining mild surfactants and delivering larger levels of benefit agents than previously possible. The bar can be cast melt at lower levels of water than previously believed possible.

Specifically, the subject invention comprises bar composition designed to be cast melt comprising:

(a) 10 to 40% by wt. synthetic non-soap detergent or mixture of synthetic non-soap detergent;

(b) 10% to 50% by wt. of a polyol which polyol comprises a mixture of (i) a polyalkylene glycol having molecular weight of about 2000 to 20,000, melting point of about 55° to 65° C. and general structure as follows:

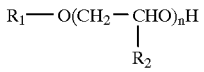

wherein $R_1$=Hydrogen, $C_1$ to $C_4$ alkyl;

$R_2$=Hydrogen, $CH_3$; and n=about 40 to 200, preferably 40 to 100; and (ii) a $C_2$to $C_4$ alkylene polyol having a melting point which is liquid at room temperature (e.g., ethylene glycol, propylene glycol or glycerin);

wherein ratio of alkylene polyol to polyalkylene glycol or ratio of alkylene glycol plus benefit agent of component (e) to polyalkylene glycol is about 0.8:1 and higher;

(c) 5% to 40% water insoluble structurant selected from the group consisting of preferably straight chain, saturated $C_8$ to $C_{24}$ free fatty acids and $C_8$ to $C_{20}$, preferably straight-chain, saturated alkanols;

(d) greater than 8%, preferably 10% to 30% soap;

(e) 0% to 30%, preferably 1% to 25%, more preferably 1.5% to 15% of a benefit agent (e.g., silicone or other emollient oil); and (f) 2% to less than 10%, preferably 2% to 8% water;

wherein ratio of total polyol (b) to water is at least about 3:1, more preferably at least about 4:1

In a preferred embodiment of the invention, addition of 1% to 10%, preferably 2 to 5% of a wax as fatty acid replacement enhances user properties even further.

DETAILED DESCRIPTION OF THE INVENTION

The present invention relates to cast melt bar compositions comprising a mild surfactant system (e.g., synthetic, non-soap actives). Since these are not soap-structured systems, the surfactants and solvents in which the surfactants are dissolved or disperse must be carefully selected to insure the surfactants readily dissolve or disperse to form a homogeneous, preferably isotropic, melt. The melt in turn must be of low enough viscosity to be pumped, yet the cooled solid must have structural integrity expected of a personal washing bar.

Prior art cast melt bars (e.g., the Kacher et al. bars discussed above) required relatively large amounts of water to ensure a pumpable viscosity and, without wishing to be bound by theory, the present invention is believed to avoid use of such large quantities of water through the use of greater amounts of lower molecular weight solvent.

Prior art references concerned with extruded bars (e.g., the Massaro et al. invention discussed above) do not even recognize the criticality of the solvent system since a pumpable, low viscosity mixture is not a concern for extruded bars.

Unexpectedly, applicants have found an extremely low water region where, through manipulation of solvent system (and ratio of polyol to water) it is possible to create a low viscosity (e.g., less than about 10,000 cps at 90° C.), pumpable mixture of synthetic, non-soap surfactant. Further, because it is a cast melt bar, it is possible to use larger amounts of emollients/benefit agents than possible using extrusion bars (in extrusion bars, the benefit agent is lost in processing).

In fact, applicants have identified a low water, cast melt composition which enables the delivery of larger amounts of emollients than previously possible.

The various components of the system are described in greater detail below.

(a) Synthetic Non Soap Surfactant

The bars of the invention comprise 10% to 50%, preferably greater than 20% to 50%, more preferably 25% to 50% of total bar composition of synthetic non-soap surfactant.

More specifically, the surfactant system will generally comprise at least one anionic surfactant, an amphoteric surfactant or, preferably mixtures of anionic or anionics and zwitterionic surfactant.

The anionic surfactant which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium laurel ether sulfates are preferred.

The anionic may also be alkyl sulfosuccinates (including mono and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$$R^1O_2CCH_2CH(SO_3M)CO_2M;$$

and amide-MEA sulfosuccinates of the formula $$R^1CONHCH_2CH_2O_2CCH_2CH(SO_3M)CO_2M$$

wherein $R^1$ ranges from $C_8$–$C_{22}$ alkyl and M is a solubilizing cation.

Sarcosinates are generally indicated by the formula $$RCON(CH_3)CH_2CO_2M,$$

wherein R ranges from $C_8$–$C_{20}$ alkyl and M is a solubilizing cation.

Taurates are generally identified by formula $$R^2CONR^3CH_2CH_2SO_3M$$

wherein $R^2$ ranges from $C_8$–$C_{20}$ alkyl, $R^3$ ranges from $C_1$–$C_4$ alkyl and M is a solubilizing cation.

Particularly preferred are the $C_8$–$C_8$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 10% to about 40% by weight of the total bar composition. Preferably, this component is present from about 15% to about 35%.

The acyl isethionate may be an alkoxylated isethionate such as is described in llardi et al., U.S. Pat. No. 5,393,466, hereby incorporated by reference. This compound has the general formula

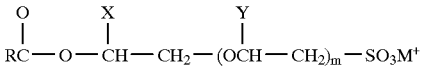

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

In general the anionic component will comprise from about 10 to 40% of the bar composition, preferably 15 to 35%.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

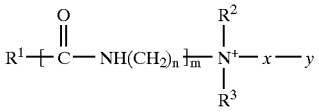

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

n is 2 to 4;

m is 0 to 1;

x is alkylene of 1 to 3 carbon atoms optionally substituted with hydroxyl, and y is $—CO_2—$ or $—SO_3—$ Suitable amphoteric detergents within the above general formula include simple betaines of formula:

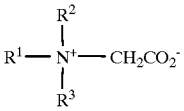

and amido betaines of formula:

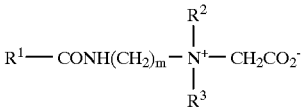

where m is 2 or 3.

In both formulae $R^1$ is alkyl or alkenyl of 7 to 18 carbons; and $R^2$ and $R^3$ are independently alkyl, hydroxyalkyl or carboxylalkyl of 1 to 3 carbons. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula

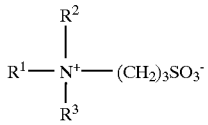

or

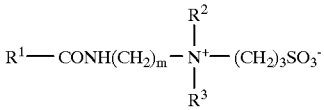

where m is 2 or 3, or variants of these in which $—(CH_2)_3SO_3—$ is replaced by

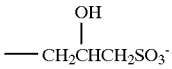

In these formulae $R^1$, $R^2$ and $R^3$ are as discussed for the amido betaine.

Amphoteric generally comprises 1% to 10% of the bar composition.

Other surfactants (i.e., nonionics, cationics) may also be optionally used although these generally would not comprise more than 0.01 to 10% b wt. of the bar composition.

Nonionic surfactants include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference and polyhydroxyamides such as described in U.S. Pat. No. 5,312,954 to Lefton et al., hereby incorporated into the subject application by reference.

Examples of cationic detergents are the quaternary ammonium compounds such as alkyldimethylammonium halogenides.

Other surfactants which may be used are described in U.S. Pat. No. 3,723,325 to Parran Jr. and "Surface Active Agents and Detergents" (Volume I & II) by Schwartz, Perry & Berch, both of which are also incorporated into the subject application by reference.

A preferred composition comprises 10% to 40% acyl isethionate and 1% to 10% betaine. The surfactants will comprise greater than 20%, preferably 25% to 40% of the bar composition.

(b) Polyol Composition

A second required component of the invention is a mixture of polyols comprising a polyalkylene glycol component and an alkylene polyol component wherein the ratio of either alkylene polyol (AP) or combination of alkylene polyol plus benefit agent to polyalkylene glycol is about 0.8:1 and above, preferably greater than 1.5:1, more preferably greater than 2:1. Preferably, the upper limit should be less than about 20:1.

The polyalkylene glycol should be a moderately high molecular weight or low molecular weight material having molecular weight range from about 2000 up to about 20,000, preferably 4,000 to 10,000 having MP between 55° C.–65° C.

The alkylene polyol has a general structure as follows:

$R_1$—O($CH_2$—CHO)$_n$H wherein $R_1$ is hydrogen (H), $C_1$ to $C_4$ alkyl;

$R_2$ is H or $CH_3$; and n=about 40 to 200

The alkylene polyol is preferably a $C_2$–$C_4$ alkylene polyol material having a melting point such that it is liquid at room temperature. Examples include ethylene glycol, propylene glycol and glycerin.

Because of the low water levels used in these melt cast bars (which help ensure good pumpability), it is critical, as noted above, that the alkylene polyol or combination of alkylene polyol plus benefit agent levels predominate over the levels of polyalkylene glycol.

(c) Water-insoluble Structurant/Fatty Acid

A third required component of the invention is use of about 5% to 40%, preferably 10 to 25% of a water insoluble structurant such as, for example fatty acids. Suitable materials which are particularly envisaged are fatty acids, particularly those having a carbon chain of 12 to 24 carbon atoms. Examples are lauric, myristic, palmitic, stearic, arachidonic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/liter at 20° C.

The relative proportions of the water soluble structurants (b) and water insoluble structurants (d) govern the rate at which the bar wears during use. The presence of the water insoluble structurant tends to delay dissolution of the bar when exposed to water during use and hence retard the rate of wear.

Preferably the total quantity of component (d) is from 5% to 40% by weight of the composition, more preferably 10 to 25%.

(d) Soap

A fourth required component of the invention is soap, i.e., greater than about 8% to about 30% soap, preferably greater than 10% to about 20%.

By soap is meant, salts of monocarboxylic fatty acid having chain lengths of 8 to 22 carbons, preferably $C_{16}$ to $C_{22}$ for best structuring and mildness.

While not wishing to be bound by theory, minimum levels of soap are believed to be an important distinction over extrusion bars which do not necessarily require such high levels of soap.

(e) Benefit Agent

One key element of the invention is the ability, because of the cast melt process, to incorporate 0 to 30%, preferably 1 to 25% of a benefit agent in the bar composition.

The benefit agent "composition" of the subject invention may be a single benefit agent component or it may be a benefit agent compound added via a carrier. Further the benefit agent composition may be a mixture of two or more compounds one or all of which may have a beneficial aspect. In addition, the benefit agent itself may act as a carrier for other components one may wish to add to the bar composition.

The benefit agent can be an "emollient oil" by which is meant a substance which softens the skin (stratum corneum) by increasing into water content and keeping it soft by retarding decrease of water content.

Preferred emollients include:

(a) silicone oils, gums and modifications thereof such as linear and cyclic polydimethylsiloxanes; amino, alkyl alkylaryl and aryl silicone oils;

(b) fats and oils including natural fats and oils such as jojoba, soybean, rice bran, avocado, almond, olive, sesame, persic, castor, coconut, mink oils; cacao fat; beef tallow, lard; hardened oils obtained by hydrogenating the aforementioned oils; and synthetic mono, di and triglycerides such as myristic acid glyceride and 2-ethylhexanoic acid glyceride;

(c) waxes such as carnauba, spermaceti, beeswax, lanolin and derivatives thereof;

(d) hydrophobic plant extracts;

(e) hydrocarbons such as liquid paraffins, vaseline, microcrystalline wax, ceresin, squalene, pristan and mineral oil;

(f) higher fatty acids such as lauric, myristic, palmitic, stearic, behenic, oleic, linoleic, linolenic, lanolic, isostearic and poly unsaturated fatty acids (PUFA);

(g) higher alcohols such as lauryl, cetyl, stearyl, oleyl, behenyl, cholesterol and 2-hexydecanol alcohol;

(h) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate and alkyl tartrate;

(i) essential oils such as mentha, jasmine, camphor, white cedar, bitter orange peel, ryu, turpentine, cinnamon, bergamot, citrus unshiu, calamus, pine, lavender, bay, clove, hiba, eucalyptus, lemon, starflower, thyme, peppermint, rose, sage, menthol, cineole, eugenol, citral, citronelle, borneol, linalool, geraniol, evening primrose, camphor, thymol, spirantol, penene, limonene and terpenoid oils;

(j) lipids such as cholesterol, ceramides, sucrose esters and pseudoceramides as described in European Patent Specification No. 556,957;

(k) vitamins such as vitamin A and E, and vitamin alkyl esters, including those vitamin C alkyl esters;

(l) sunscreens such as octyl methoxyl cinnamate (Parsol MCX) and butyl methoxy benzoylmethane (Parsol 1789);

(m) phospholipids; and (n) mixtures of any of the foregoing components.

A particularly preferred benefit agent is silicone, preferably silicones having viscosity greater than about 10,000 centipoise. The silicone may be a gum and/or it may be a mixture of silicones. One example is polydimethylsiloxane having viscosity of about 60,000 centistokes.

Water

Finally, as indicated above, a further criticality of the invention is the use of low levels of water, i.e., 2% to less than 10%, preferably 2% to 8%, more preferably 3% to 7% by weight. Water levels are kept purposefully low to ensure isotropic, pumpable melts which, upon cooling, form rigid solids. Excess water will result in phase separation in the melt and unacceptably soft solids when cooled.

Because water levels are so low, it is important that levels of polyol to water be at least about 3:1 preferably greater than 3.5 to 1, more preferably greater than 4.1. That is, the use of predominantly low molecular weight polyol (recall alkylene polyol or alkylene polyol plus benefit agent to PAG level is at least about 0.8:1) ensures that the composition is sufficiently pumpable.

The invention may further comprise use of a wax as a fafty acid replacement. Preferably wax may improve 1% to 10%, more preferably 2% to 5% of the bar composition.

An example of a wax which may be used includes paraffin wax (MP 45° to 70° C.).

All percentages mentioned above are intended to be by wt. unless otherwise indicated.

The following examples are meant for illustrative purposes only and are not intended to limit the claims in any way.

EXAMPLES

Materials

Sodium cocoyl isethionate was supplied by Lever Hammond. Polyethylene glycol was supplied by Union Carbide. Cocoamidopropyl betaine and Tego Care (glyceryl stearate) were supplied by Goldschmidt. Palmitic/stearic acid was supplied by Emery. Polydimethylsiloxane was supplied by General Electric. Propylene glycol was supplied by Fisher. Paraffin was supplied by Moore & Munger Marketing Inc.

Protocol

Zein Test

In an 8 oz. jar, 30 mls. of a 2.0% aqueous dispersion of the bar formulations were prepared. The dispersions sat in a 45° C. bath until fully dissolved. Upon equilibration at room temperature, 1.50 grams of zein were added to each solution with rapid stirring for one hour. The solutions were then transferred to centrifuge tubes and centrifuged for 30 minutes at approximately 3000 rpms. The undissolved zein was isolated, rinsed and allowed to dry in a 60° C. vacuum oven to a constant weight. The percent zein solubilized, which is proportional to irritation potential, was determined gravimetrically.

The Mush Test

Bar mush was determined by placing the bar in a plastic dish and adding 25 mls. of water. The dish was covered and remained untouched for 24 hours. The subsequent mush layer was gently scraped off with a spatula, weighed, and compared to that of a commercially available Dove® bar.

The Wear Rate Test

A one half gallon container was placed under running tap water at 105° F. The hands and test bar were submerged in the water for 3 seconds. They were then removed and the bar was rotated in the hand ten times. The procedure was repeated and the bar was submerged a final time and stored in a flat bottom soap dish containing 7.5 ml. The washing procedure was done four times on day one and four times on day two. The bar was left to dry overnight and the average grams per wash (for 2 bars) was calculated and reported.

Silicone Detection via FTIR

Infrared spectra were collected on a Nicolet 5SXB FTIR spectrometer equipped with horizontal attenuated total reflectance (ATR) accessory. The ATR element was a 60 ZnSe crystal with a 1 cm.×7 cm. sampling surface. Bar samples were smeared along the surface of the crystal. Spectra were then collected at 8 $cm.^{-1}$ resolution and 32 scans were averaged. Relative differences in PDMS concentration were estimated by comparing the averages of the silicone peak amplitudes at 800 $cm.^{-1}$ In-Vitro Deposition of Silicone Porcine skin was shaved, dermatomed and thin-sectioned into 25 $cm.^2$ pieces prior to treatment. The skin sample was then treated by rubbing the bar sample across the skin 10 times, in a back and forth motion. The resulting liquor was lathered for 30 seconds and then rinsed for 10 seconds with water which was regulated at 90–95° F. The treated skin sample was placed in a borosilicate scintillation vial that contained 10 ml. of xylene. The samples were placed on a platform shaker for 1 hour to allow for extraction of the silicone. After the extraction period, the skin was removed from the vial and the extract was analyzed by Graphite Furnace Atomic Absorption for silicone content. Sample solutions were tested against a 10 ppm silicon standard.

Example 1

Bars having the following formulations were prepared

TABLE 1

Cast Melt Formulations

| Component | | 1 | 2 |
|---|---|---|---|
| 1 | Sodium Cocyl Isethionate | 28.5 | 28.5 |
| 2 | Cocamidopropyl Betaine | 5.0 | 5.0 |
| 3 | Sodium Stearate | 20.0 | 15.0 |
| 4 | Polyethylene Glycol 8000 | 5.0 | 10.0 |
| 5 | Palmitic/Stearic Acid | 13.1 | 13.1 |
| 6 | Paraffin Wax | 3.0 | 3.0 |
| | Misc. (e.g., salts) | 1.4 | 1.4 |
| 7 | Propylene Glycol | 18.3 | 18.3 |
| 8 | Water | 5.7 | 5.7 |

The bars were prepared as follows:

(1) Components 4 to 7 were added and heated to 90° C. with stirring;

(2) Component 3 was added and dissolved followed by addition of components 2 and 8;

(3) Once an isotropic mix was formed, component 1 was added and dissolved;

(4) Once isotropic hot melt was formed, it was prepared and poured into mold.

It should be noted that order was not noted and many other possibilities can be done.

Example 2

Acceptable Mush and Wear

Both bars 1 and 2 formed relatively low viscosity isotropic melts at approximately 90° C. These hot solutions had an approximate viscosity of 1000 cps. at 20 $sec^{-1}$. They were found to be readily pumpable into molds when prepared at a copacker. The resulting bars lathered well and had relatively low mush values of about 6.6 grams of mush after 24 hours in water and gentle scraping (Bar 1); and 4.4 grams of mush (Bar 2) compared to Dove® (about 12.0). Further, the bars had relatively low wear rates of about 2.8 grams/wash (Bar 1) and 2.4 grams/wash (Bar 2) (equal to Dove®). The numbers were surprising considering the relatively high percentage of liquid fraction (i.e., water and polyol) contained in these bars. It thus showed a good quality bar could be readily made by cast melt while allowing incorporation of high liquid fraction.

Example 3

Low Irritation

The irritation potentials of these formulations were first approximated by using the zein test and noting values of about 20% zein dissolved. These are about 100% less zein dissolved than a commercial Dove® bar. This is an indication of enhanced irritation reduction.

Example 4

Incorporating Silicone to Base Composition

Applicants sought to determine to what extent emollient oils, specifically 60,000 cs polydimethyl siloxane, could be deposited onto the skin from a selected cast melt formulation. The use of cast melt technology to deliver these oils in the washing process is attractive for two reasons:

1. Emollient oils are readily incorporated into the cast-melt bar by partial replacement of its liquid fraction.
2. Large discrete droplets of these oils can be more easily maintained within the bar matrix when compared to an extrusion process.

Regarding the first point, conventional syndet bars tend to soften rapidly when emollient oils such as silicone or mineral oil are directly added in excess of 1%, particularly in excess of 3–4%, making the extrusion process difficult or impossible.

Based on formulation 2 from Table 1, propylene glycol was partially replaced by 5%, 7.5% and 10% PDMS (formulations 3, 4 and 5 respectively, Table 2 below).

TABLE 2

Formulations Containing Polydimethylsiloxane

| | 3 | 4 | 4 |
|---|---|---|---|
| Sodium Cocyl Isethionate | 28.5 | 28.5 | 28.5 |
| Cocamidopropyl Betaine | 5.0 | 5.0 | 5.0 |
| Sodium Stearate | 10.0 | 10.0 | 10.0 |
| Polyethylene Glycol 8000 | 10.00 | 10.0 | 10.0 |
| Palmitic/Stearic Acid | 14.5 | 14.5 | 14.5 |
| Paraffin Wax | 3.0 | 3.0 | 3.0 |
| Glyceryl Stearate (Tego Care) | 5.0 | 5.0 | 5.0 |
| Propylene Glycol | 13.3 | 10.8 | 8.3 |
| Water | 5.7 | 5.7 | 5.7 |
| Polydimethyl Siloxane | 5.0 | 7.5 | 10.0 |

PDMS appeared to be uniformly dispersed in the melt upon stirring.

Upon pouring and cooling it was necessary to determine to what extent the PDMS migrated within the bar matrix. It was possible that the time involved int he cooling process would be enough to allow the silicone to coalesce and float to the surface of the bar. To test, a bar containing 7.5% PDMS was sectioned with a scalpel. Samples were taken from the top, bottom, left side, right side, and center of the bar. They were then smeared on the Zn-Se crystal of a Nicolet FTIR. Absorbance spectra of the Si—O band (800 $cm.^{-1}$) were recorded and showed that silicone was evenly distributed throughout the bar. Specifically, the uniformity of the peak heights suggest that silicone did not migrate appreciably during the cooling process and remained evenly distributed throughout the bar.

Example 5

Deposition

Deposition of PDMS onto the Skin

The extent to which PDMS may be deposited onto skin from bar formulations 3 (5% PDMS), 4 (7.5% PDMS), and 5 (10% PDMS) was gaged by using in-vitro deposition onto pig skin relative to conventional terms (5% PDMS used in conventional processing) and the results are set forth in the table below.

Polydimethylsiloxane Deposition on Pig Skin

| Dove(R)* | Lux(R)* | Ex. 3 PDMS)Δ | Ex. 4 (7.5% PDMS)Δ | Ex.5 (10.0% PDMS)Δ |
|---|---|---|---|---|
| 0.25 | 0.25 | 1.6 | 2.1 | 8.5 |

micrograms/sq.cm.

* 5% PDMS dispersed in conventional bar using conventional (non cast-melt) processing.

Δ PDMS applied in cast melt bar processing.

Deposition from the cast-melt formulations of the invention was significantly greater than that obtained from conventional bars (Dove® and Lux®) in which 5% PDMS was simply dispersed.

We claim:

1. A cast melt bar composition comprising:

(a) 10 to 40% by wt. synthetic, non-soap detergent or mixture of synthetic non-soap detergents;

(b) 10% to 50% by wt. polyol composition which polyol composition comprises a mixture of:

(i) polyalkylene glycol having MW between about 2,000 and 20,000 and a melting point of about 55° C. to 65° C.; and (ii) a $C_2$–$C_4$ alkylene polyol which is liquid at room temperature selected from the group consisting of ethylene glycol, propylene glycol and glycerin;

wherein the ratio of alkylene polyol or alkylene polyol plus benefit agent of component (e) below to polyalkylene glycol is about 1.5:1 and higher;

(c) 5% to 40% by weight of a water soluble structurant selected from the group consisting of $C_8$ to $C_{24}$ fatty acids and $C_8$ to $C_{20}$ alkanols;

(d) greater than about 8% to 20% soap;

(e) 0% to 30% of a benefit agent; and (f) 2% to less than 10% water;

wherein the ratio of polyol (b) to water is at least about 3:1;

wherein said bar is prepared by melt cast process.

2. A composition according to claim 1, wherein the polyalkylene glycol has MW of about 4,000 to 10,000.

3. A composition according to claim 1, wherein the polyalkylene glycol has the following structure

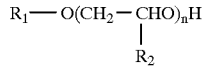

wherein $R_1$=H, $C_1$ to $C_4$ alkyl;

$R_2$=H, $CH_3$; and n=about 40 to 200.

4. A composition according to claim 1, wherein the fatty acid comprises 10% to 25% of the composition.

5. A composition according to claim 1, wherein the fatty acid is a straight chain, saturated $C_{12}$ to $C_{14}$ fatty acid.

6. A composition according to claim 1, wherein the alkanol is cetyl alcohol.

7. A composition according to claim 1, comprising at least 10% to 20% soap.

8. A composition according to claim 1, wherein ratio of polyol (b) to water (f) is at least about 3.5:1.

9. A composition according to claim 8, wherein ratio of polyol (b), to water (f) is at least about 4:1.

10. A composition according to claim 1, further comprising 1% to 10% wax.

* * * * *